US010760879B2

(12) United States Patent
Stark et al.

(10) Patent No.: US 10,760,879 B2
(45) Date of Patent: Sep. 1, 2020

(54) ANTI-UNMANNED AERIAL VEHICLE DEFENSE APPARATUS, PROTECTIVE DEVICE FOR FIGHTING AN UNMANNED AIRCRAFT AND METHOD FOR OPERATING A PROTECTIVE DEVICE

(71) Applicant: DIEHL DEFENCE GMBH & CO. KG, Ueberlingen (DE)

(72) Inventors: Robert Stark, Bad Windsheim (DE); Juergen Urban, Erlangen (DE)

(73) Assignee: Diehl Defence GmbH & Co. KG, Ueberlingen (DE)

( * ) Notice: Subject to any disclaimer, the term of this patent is extended or adjusted under 35 U.S.C. 154(b) by 464 days.

(21) Appl. No.: 15/468,173

(22) Filed: Mar. 24, 2017

(65) Prior Publication Data

US 2017/0191804 A1 Jul. 6, 2017

Related U.S. Application Data

(63) Continuation of application No. PCT/EP2015/001773, filed on Sep. 3, 2015.

(30) Foreign Application Priority Data

Sep. 24, 2014 (DE) ..... 10 2014 014 117

(51) Int. Cl.
*F41H 13/00* (2006.01)
*F41H 11/02* (2006.01)

(52) U.S. Cl.
CPC ..... *F41H 13/0093* (2013.01); *F41H 11/02* (2013.01)

(58) Field of Classification Search
CPC ..... F41H 13/0093; F41H 11/02
See application file for complete search history.

(56) References Cited

U.S. PATENT DOCUMENTS 4,456,912 A * 6/1984 Ensley ..... F41H 11/02 330/4
5,198,607 A * 3/1993 Livingston ..... F41H 13/0062 89/1.11
5,293,527 A * 3/1994 Sutton ..... F41H 13/0093 180/167

(Continued)

FOREIGN PATENT DOCUMENTS

EP 2397809 A2 12/2011
EP 2482025 A2 8/2012

(Continued)

*Primary Examiner* — Benjamin P Lee
(74) *Attorney, Agent, or Firm* — Laurence A. Greenberg; Werner H. Stemer; Ralph E. Locher

(57) ABSTRACT

A defense device for combating an unmanned aircraft includes a communications device configured for receiving communications information transmitted by at least one external signal source, an emitting device configured for producing and emitting a high-energy electromagnetic pulse in the event of triggering of the emitting device, and a control device configured to trigger the emission of the high-energy electromagnetic pulse depending on communications information received by the communications device. A protective configuration for combating an unmanned aircraft and a method for operating a protective configuration are also provided.

21 Claims, 7 Drawing Sheets

(56) References Cited

U.S. PATENT DOCUMENTS

| | | | | |
|---|---|---|---|---|
| 5,786,786 | A * | 7/1998 | Small | G01S 7/38 342/13 |
| 6,825,792 | B1 * | 11/2004 | Letovsky | F41H 13/00 250/251 |
| 7,629,918 | B2 * | 12/2009 | Brown | F41H 13/0043 342/13 |
| 8,576,109 | B2 * | 11/2013 | Stark | F41H 13/0093 307/106 |
| 8,927,935 | B1 * | 1/2015 | Meline | F41H 13/0062 250/340 |
| 8,981,261 | B1 * | 3/2015 | Tillotson | F41H 13/0093 219/201 |
| 9,079,555 | B2 * | 7/2015 | Kaufman | B60R 25/04 |
| 9,529,360 | B1 * | 12/2016 | Melamed | G01S 3/46 |
| 9,996,079 | B2 * | 6/2018 | Magy | F41H 13/00 |
| 2007/0144392 | A1 * | 6/2007 | Wood | H05H 1/52 102/214 |
| 2008/0174469 | A1 * | 7/2008 | Stark | F41H 11/02 342/14 |
| 2012/0212363 | A1 | 8/2012 | Brasile et al. | |
| 2014/0251123 | A1 | 9/2014 | Venema | |
| 2017/0192089 | A1 * | 7/2017 | Parker | G01S 3/782 |
| 2018/0080747 | A1 * | 3/2018 | Nishikata | F41H 11/02 |
| 2018/0092195 | A1 * | 3/2018 | Nishikata | H05H 1/24 |
| 2019/0120600 | A1 * | 4/2019 | Holihan | F41H 11/02 |

FOREIGN PATENT DOCUMENTS

| | | | |
|---|---|---|---|
| FR | 2793973 | A1 | 11/2000 |
| WO | 2005003676 | A2 | 1/2005 |
| WO | 2007059508 | A1 | 5/2007 |
| WO | 2009091424 | A1 | 7/2009 |
| WO | 2010144105 | A2 | 12/2010 |
| WO | 2016045772 | A1 | 3/2016 |

* cited by examiner

ANTI-UNMANNED AERIAL VEHICLE DEFENSE APPARATUS, PROTECTIVE DEVICE FOR FIGHTING AN UNMANNED AIRCRAFT AND METHOD FOR OPERATING A PROTECTIVE DEVICE

CROSS-REFERENCE TO RELATED APPLICATION

This is a continuation application, under 35 U.S.C. § 120, of copending International Application PCT/EP2015/001773, filed Sep. 3, 2015, which designated the United States; this application also claims the priority, under 35 U.S.C. § 119, of German Application DE 10 2014 014 117.9, filed Sep. 24, 2014; the prior applications are herewith incorporated by reference in their entirety.

BACKGROUND OF THE INVENTION

Field of the Invention

The invention relates to an anti-unmanned aerial vehicle defense apparatus, a protective device for fighting an unmanned aircraft and a method for operating a protective device.

Drones or unmanned aircraft (unmanned aerial vehicle, UAV) are both increasingly used in the military sector and also in the civil sector. Unmanned aircraft are used on one hand for data acquisition, in particular for providing image material, and on the other hand as a platform for weapon systems. In many areas, the use of unmanned aircraft should be prevented. That can be necessary in order to achieve reliable protection of objects, for example the protection of field camps, airport sites, embassies or power plants. Gatherings of military or civil persons should also be protected against attack by an unmanned aircraft. For example, there can be a desire to protect large events, such as for example football events, mass rallies, state occasions or electoral events. There also can often be a desire to protect areas against monitoring by drones.

In the military sector, it is known to combat drones with lethal weapons. Thus, for example, drones are combated by a barrage at a moderate flying altitude, by the use of "kill vehicles" or by lasers. It is problematic with the use of lethal weapons that the target must be hit very accurately. In addition, there is always the risk of damaging uninvolved persons and of collateral damage. Therefore, the use of suitable deterrents for the protection of persons and/or the protection of objects in the civil sector is hardly possible.

Alternatively, it is possible to use interference transmitters in order to interfere with the radio-based control of unmanned aircraft. Suitable interference transmitters are, however, not effective if the unmanned aircraft is guided autonomously, for example by autonomous guidance using a satellite navigation system and/or an image processing system.

SUMMARY OF THE INVENTION

It is accordingly an object of the invention to provide an improved anti-unmanned aerial vehicle defense apparatus, a protective device for fighting an unmanned aircraft and a method for operating a protective device, which overcome the hereinafore-mentioned disadvantages of the heretofore-known apparatuses, devices and methods of this general type and which in particular enable their use in the civil application sector.

With the foregoing and other objects in view there is provided, in accordance with the invention, a defense apparatus for combating an unmanned aircraft, which comprises the following components:

- a communications device that is constructed for receiving communications information transmitted by at least one external signal source,
- an emitting device that is constructed for producing and emitting a high-energy electromagnetic pulse when the emitting device is triggered, and
- a control device that is constructed to trigger the emission of the high-energy electromagnetic pulse depending on communications information received by the communications device.

According to the invention, it is proposed to combat unmanned aircraft by the targeted emission of electromagnetic pulses. High-energy electromagnetic pulses degrade the operation of the receiving and/or control electronics of unmanned aircraft. An unmanned aircraft can be prevented from using weapon systems disposed on the unmanned aircraft and/or from acquiring or transmitting data following an attack with an electromagnetic pulse. In addition, sometimes ignition circuit electronics can be triggered by an electromagnetic pulse, so that explosive weapons or similar transported by the unmanned aircraft can be destroyed at a safe distance from an area to be protected. Combating an unmanned aircraft by emitting a high-energy electromagnetic pulse can thereby foil a mission of an unmanned aircraft with high probability, wherein at the same time collateral damage is prevented or minimized. In particular, microwave pulses that are emitted directionally or non-directionally can be used as an electromagnetic pulse.

The defense apparatus according to the invention should be flexible to use and a protective configuration for the protection of extended areas should be able to be set up rapidly and simply by the use of the defense apparatus according to the invention. Therefore, the components of the defense apparatus according to the invention are advantageously disposed in and/or on a housing. The housing can be portable. Advantageously, a modular construction is used, in which individual components, for example antennas and/or sensors disposed on the defense apparatus that protrude beyond the housing, are foldable, can be demounted or similar.

The requirements for protective configurations for the protection of extended areas against unmanned aircraft vary markedly. The areas that are to be protected, or in which unmanned aircraft are to be combated in the event of penetration, can vary in size and environment. Thus, the use thereof in densely developed urban areas is desired as in an open, substantially construction-free environment. In order to achieve high flexibility of the defense apparatus according to the invention and to be able to easily integrate the defense apparatus within more complex protective configurations, it is provided according to the invention that the defense apparatus includes a communications device that is constructed for receiving communications information and that the emission of the high-energy electromagnetic pulse can be carried out depending on that communications information.

The external signal source can be constructed in various ways. In particular, the external signal source can be a further defense apparatus, so that a combination of defense apparatuses is formed that exchange sensor information for example, can transmit electromagnetic pulses in a coordinated manner in defined areas of the environment and/or can be commonly controlled by a user.

A detecting device for detecting unmanned aircraft can alternatively or additionally be provided as the external signal source. Different and/or spaced apart sensors can be used for the detection of the surroundings.

An operating device can also be used as the external signal source in order to in particular incorporate an operator into the operation of the defense apparatus. For example, triggering of the emitting device can be confirmed by using the operating device in order to implement a "human-in-the-loop" process, with which final triggering is always dependent on the decision of a human being. Alternatively or additionally, the emission of the high-energy electromagnetic pulse can also be directly triggered by using the operating device and/or the defense apparatus can be configured through the use thereof. The communications between the defense apparatus and the external signal source use in particular algorithms for authenticating the defense apparatus or the external signal source and are preferably carried out in an encoded form.

Advantageously, but not downwardly limiting, it is possible to combat unmanned aircraft with a range of at least 100 m, in particular of at least several 100 m. In order to extend the range in which combating unmanned aircraft is possible, a plurality of defense apparatuses can be used that communicate by using the respective communications devices.

Advantageously, the defense apparatus can be constructed for battery operation, whereby mains-independent operation of the defense apparatus is possible. Alternatively or additionally, it is possible that the defense apparatus includes a mains connection to a power supply. The communications device can advantageously be a communications device for wireless communications. The communications can be carried out by using standard protocols, for example W-LAN or Bluetooth. Alternatively or additionally, it is possible that the communications device is constructed for wired communications, for example by using Ethernet.

The emitting device can include at least one antenna, a pulse-forming network and a high voltage pulse generator. The pulse-forming network is used as an energy storage device and can be constructed as a conductor-like wiring configuration of capacitors. When the pulse-forming network is discharged, a pulse-shaped output pulse is produced, which can be delivered to the antenna. The pulse-forming network is charged by a charging unit prior to the emission of the electromagnetic pulse, preferably as early as at the start of operation of the defense apparatus.

During emission of the electromagnetic pulse, the pulse-forming network should be discharged very rapidly. During this discharge, large currents flow. Advantageously, discharging can be carried out by using a spark gap. For this purpose, a high voltage pulse of the high voltage pulse generator can be delivered to the spark gap, whereby the spark gap becomes conductive for a limited period of time.

If a plurality of antennas is used, they can in particular be disposed as an antenna array.

The at least one antenna is preferably constructed for directed emission of the electromagnetic pulse in a predetermined solid angle range relative to the antenna. Alternatively or additionally, it would also be possible to use at least one antenna that emits the electromagnetic pulse in an undirected manner.

Advantageously, the antenna is disposed on a directing unit that can be pivoted about at least one pivot axis relative to a housing of the defense apparatus. Two pivot axes are preferably provided, wherein one pivot axis enables rotation of the directing unit and thereby the antenna about a vertical axis into the operating position and a second pivot unit adjusts the elevation of the emitting direction. Advantageously, the pivot axis is or the pivot axes are each associated with an actuator for pivoting the directing unit about the respective pivot axis, wherein the control device is constructed for control of the actuator. It is thereby possible to adjust the solid angle in which the electromagnetic pulse is emitted by the control device.

Additionally or alternatively, it is possible that the emitting device includes a plurality of antennas as well as an associated signal adapting element for each of at least one of the antennas, wherein the signal adapting element is constructed to change the phase position and/or the amplitude of a signal delivered to the respective antenna to specify a solid angle in which emission is carried out. The signal adapting element can in the simplest case be a switch, but a circuit can also be used that includes in particular capacitors, coils and/or resistances for adjusting phase and amplitude.

The defense apparatus can include at least one sensor for detecting sensor data of an environment sector potentially containing the unmanned aircraft. The sensor or sensors can provide the control device with sensor data that can be used for reconnaissance of the airspace, for target detection and for target tracking. The sensor is preferably an optical and/or acoustic sensor and/or an electromagnetic sensor (in particular a radar sensor). Sensors for other regions of the electromagnetic spectrum can also be used and a defense apparatus can include any combinations of sensors.

The control device can be constructed to control the communications device for the transmission of sensor data and/or data derived from the sensor data to the external signal source. The external signal source can be for example an operating device for this purpose that includes a display device in order to display to a user sensor data and/or data derived from the sensor data. Advantageously, the external signal device can be a further defense apparatus. The sensor data of a plurality of defense apparatuses can be provided to all or some of the defense apparatuses in order to fuse the sensor data and to jointly analyze the sensor data.

Alternatively or additionally, it is also possible that the data derived from the sensor data include trigger information that triggers the emission of a high-energy electromagnetic pulse upon being received by a further defense apparatus, orientation information that is used by the further defense apparatus for determining an emission direction of the electromagnetic pulse, information about detected objects or similar.

The control device can preferably be constructed to acquire the sensor data and carry out an object recognition for the recognition of unmanned aircraft depending on the sensor data. In particular, the control device can be constructed to trigger the emitting device depending on the recognition of an unmanned aircraft during the object recognition. Prior to triggering the emitting device, in particular at least one actuator can be controlled for pivoting a directing unit to orient an antenna or at least one signal adapting element in order to adjust an emission direction of the electromagnetic pulse.

The triggering of the emitting device can be carried out directly upon recognition of an object. In particular, it is however possible that the control device is constructed to only trigger the emitting device following recognition of an unmanned aircraft if an operating input confirming the triggering has been detected in an operating system of the defense apparatus and/or a triggering confirmation has been received as communications information from the external signal source by using the communications device. This enables a final decision about triggering the emitting device to remain with an operator.

The control device can further be constructed to detect further environment data concerning an environment sector potentially containing the unmanned aircraft that has been sent by the external signal source as communications information, and to analyze that data during the object recognition process. The recognition and location of objects can be improved by the fusion of the sensor data of a plurality of signal sources. The use of the sensor data of a plurality of spaced apart signal sources is particularly advantageous when using acoustic sensors. A relative distance between an individual defense apparatus or a signal source containing a sensor and an object can for example be determined from the volume of the drive noise of an unmanned aircraft. If distances from a plurality of defense apparatuses or other signal sources are determined, the position of an object can be determined therefrom.

The communications device can be constructed for the automatic provision of a communications network for the external signal source or for automatic integration within a communications network provided by the external signal source. In particular, the defense apparatus or the external signal source or one of the external signal sources can be determined as the "master" that controls the defense apparatus and the external signal source or the external signal sources and/or analyzes the detected sensor data and/or controls the communications between the defense apparatus and the external signal source or the external signal sources. Alternatively, networks can be built without a central "master," in which the individual members of the network communicate with equal rights.

Advantageously, further information about the members of the network can be exchanged in the communications network. The defense apparatus and/or the external signal source can in particular include a position detection system, for example a GPS sensor, and can transmit its own position by using the communications network. In addition, the types of members of the network and the functions implemented within the members of the network can be exchanged by using the communications network. For the "master" and/or for at least some of the further members of the network, i.e. at least for one external signal source and/or at least one defense apparatus, the positional disposition and/or the capabilities of the member can thereby be provided to the communications network.

With the objects of the invention in view, there is also provided, in addition to the defense apparatus, a protective configuration for combating an unmanned aircraft, wherein the protective configuration includes at least one defense apparatus according to the invention as well as at least one external signal source.

It is possible that the external signal source or at least one of the external signal sources is an external sensor device that includes at least one sensor, a communications device and a control device, wherein the control device is constructed for acquiring the sensor data of the sensors and for controlling the communications device for transmitting the sensor data or data derived from the sensor data as communications information to the defense apparatus and/or to a further external signal source. The sensor device can be disposed on a mobile platform, for example on an airship, a balloon or an unmanned aircraft. The processing and transmission capabilities for the sensor data can correspond to those that have been described in relation to the sensor data that were acquired by the sensors of the defense apparatus.

The external signal source or at least one of the external signal sources can be an operating device or apparatus that includes an operating device for detecting operating inputs as well as a communications device on the operator side for sending operating information that is dependent on operating inputs as communications information to the defense apparatus and/or to a further external signal source. The operation of the protective configuration thereby does not have to be carried out at one of the defense apparatuses, but can conveniently be carried out at a separate operating device.

The operating device can in particular include a display device and a control device, wherein the control device is constructed for acquiring environment information received by using the communications device concerning an environment sector potentially containing the unmanned aircraft and for displaying the environment information or information derived from the environment information on the display device. In particular, images or sequences of images, in particular videos, of a detected environment sector can be displayed. If object recognition is carried out in the protective configuration that can be carried out both by one of the defense apparatuses and also directly by a sensor device and/or by the operating device, then a detected object, in particular a detected unmanned aircraft, can be marked in an image display of the environment information. The operating device can in particular be used in order to carry out a query as to whether or not triggering the emitting device should be carried out following the recognition of an object as an unmanned aircraft.

The external signal source can be a further defense apparatus according to the invention. A plurality of defense apparatuses can thereby be connected by using a communications network and can act jointly. In particular, defense apparatuses can exchange with each other sensor data or data derived from sensor data and/or the emission of electromagnetic pulses can be coordinated. If for example an unmanned aircraft to be combated is detected by one component of the protective configuration, then one or a plurality of defense apparatuses in the protective configuration can be selected, which can radiate electromagnetic pulses into the area in the which the unmanned aircraft is located. Information can be transmitted to the control devices of the corresponding defense apparatuses or it can be determined there in which direction emission is to be carried out and the emission can be carried out in a coordinated manner, in particular at the same point in time.

In the protective configuration according to the invention, any combinations of external signal sources are possible. Thus, one or a plurality of operating devices and/or one or a plurality of sensor devices and/or one or a plurality of defense apparatuses can be used as external signal sources.

With the objects of the invention in view, there is furthermore provided, in addition to the defense apparatus and the protective configuration, a method for the operation of a protective configuration according to the invention, wherein triggering the emitting device of the defense apparatus is only carried out if communications information concerning the triggering is received by the communications device. The protective configuration can include a plurality of defense apparatuses that are disposed in such a way that the areas of the environment in which the emission of the electromagnetic pulse by the respective emitting device is possible fully or partly surround and/or cover an area to be protected.

Developments of the method according to the invention result from the subordinate claims. It is of course possible to transfer features that have been described in relation to one of the objects of the invention equivalently to the further objects of the invention.

Other features which are considered as characteristic for the invention are set forth in the appended claims.

Although the invention is illustrated and described herein as embodied in an anti-unmanned aerial vehicle defense apparatus, a protective device for fighting an unmanned aircraft and a method for operating a protective device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
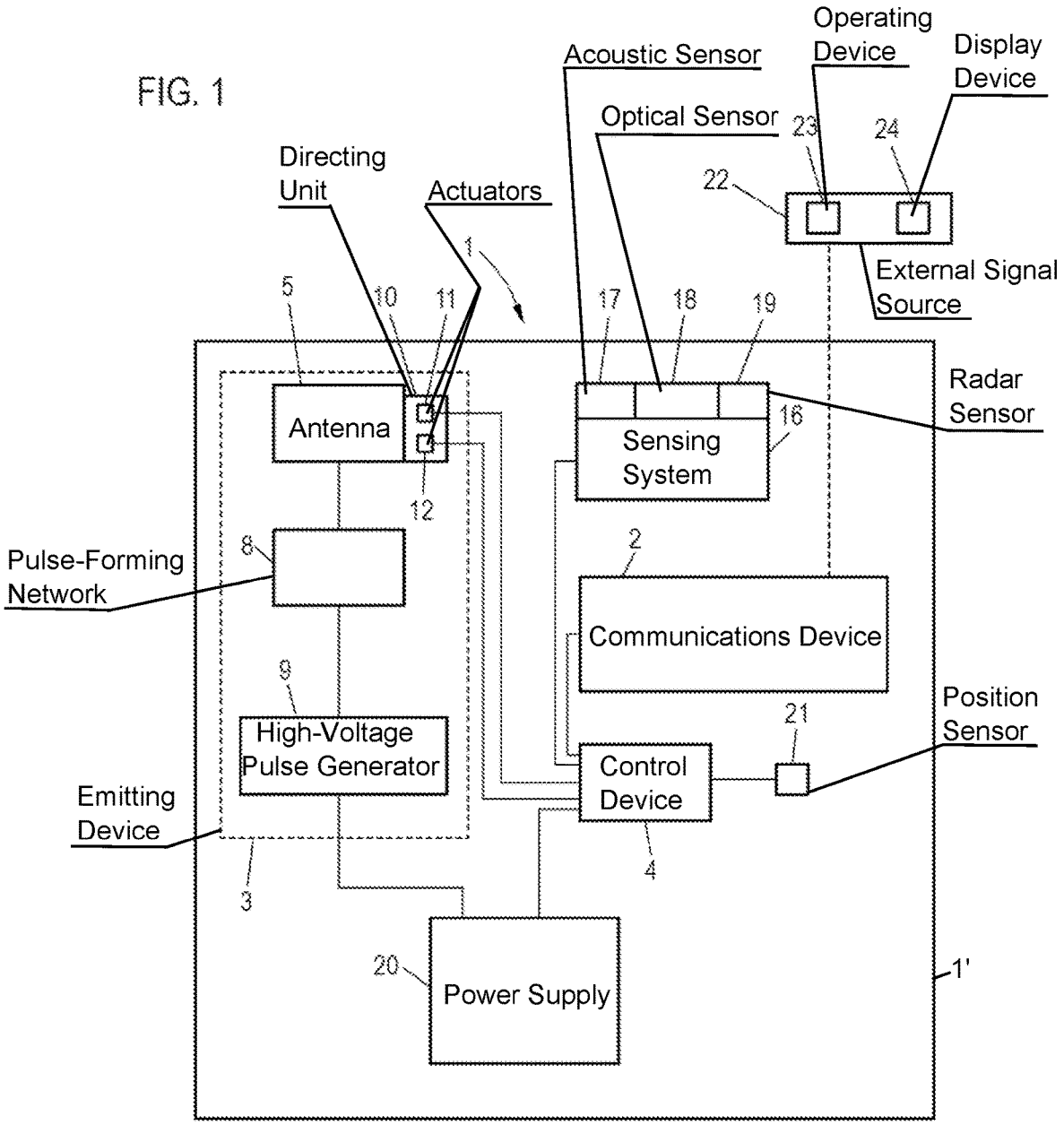
FIGS. 1 and 2 are block diagrams of exemplary embodiments of a defense apparatus according to the invention.

Referring now to the figures of the drawings in detail and first, particularly, to FIG. 1 thereof, there is seen an exemplary embodiment of a defense apparatus for combating an unmanned aircraft. The defense apparatus 1 has a housing 1' and includes a communications device 2 that is constructed for receiving communications information transmitted by at least one external signal source 22. The communications device 2 can also transmit information to the signal source 22. The defense apparatus 1 also includes an emitting device 3, which is constructed for producing and emitting a high-energy electromagnetic pulse when the emitting device 3 is triggered. The triggering of the emitting device 3 is carried out by a control device 4, wherein the control device 4 is constructed to trigger the emission depending on communications information received by the communications device 2.

The emitting device 3 includes an antenna 5, a pulse-forming network 8 and a high voltage pulse generator 9. The pulse-forming network 8 includes a conductor-like wiring configuration of capacitors, which are charged during the operation of the defense apparatus 1 by a power supply 20 that includes a charging circuit that is not shown for the pulse-forming network 8. In order to trigger the emission of the electromagnetic pulse, the control device 4 controls the power supply 20 in order to energize the high voltage pulse generator 9. A spark gap, by using which the pulse-forming network 8 can be discharged, is switched by the high voltage pulse generator 9. As a result, a current pulse is provided that can be emitted by using the antenna 5.

The antenna 5 is constructed for directed emission of the electromagnetic pulse in a predetermined solid angle relative to the antenna, i.e. a directional antenna. The antenna 5 is disposed on a pivotable directing unit 10 that enables pivoting of the antenna about two pivot axes relative to a housing that is not shown of the defense apparatus 1. An actuator 11, 12 that is associated with each of the pivot axes can be controlled by the control device 4 in order to pivot the antenna.

In order to detect an unmanned aircraft to be combated, the defense apparatus 1 includes a sensing system 16 including an acoustic sensor 17, an optical sensor 18 and an electromagnetic sensor, for example the radar sensor 19. The sensor data detected by the sensors are acquired by the control device 4 and object recognition is carried out in the sensor data for recognition of unmanned aircraft in the monitored environment. The control device 4 is also constructed to take into account further environment information during the object recognition that has been received by using the communications device 2. If, for example, a further defense apparatus with an associated sensing system or a sensor device were to be provided in the environment of the defense apparatus 1, then that further defense apparatus could provide further environment information to the control device 4 by using the communications device 2.

The control device 4 is constructed to trigger the emitting device 3 depending on the recognition of the unmanned aircraft during the object recognition. Triggering of the emitting device 3 is only carried out in the defense apparatus 1, however, after triggering confirmation has been received as communications information from an external signal source 22 by using the communications device 2 following the recognition of an unmanned aircraft. An operating device that enables the monitoring and control of the operation of the defense apparatus 1 by a user is shown as an external signal source 22.

The operating device includes an operating device 23 for detecting operating inputs. Customary operating devices such as a mouse, keyboards, joysticks, buttons or similar can be used as the operating device. The operating device also includes a display device 24. The control device 4 controls the communications device 2 to transmit image data generated from the sensor data to the operating device, whereupon that data are displayed on the display device 24. If an object is recognized as an unmanned aircraft to be combated, then a video image that is acquired by the optical sensor 18 is modified by the control device 4 by marking the unmanned aircraft as a recognized object.

Penetration by a detected unmanned aircraft into any area in which the defense apparatus 1 can be expected to successfully combat the unmanned aircraft with an electromagnetic pulse can be displayed by displaying the marker on the display device 24 and/or by a warning device that is not shown provided on the operating device. If it is confirmed by a user on the operating device that combating is to be carried out, then the operating device, i.e. the external signal source 22, transmits corresponding communications information to the defense apparatus 1, whereupon the control device 4 triggers the emission of a high-energy electromagnetic pulse by the emitting device 3. When an unmanned aircraft is recognized, prior to the triggering of the emission of the electromagnetic pulse, the actuators 11, 12 are controlled to pivot the antenna 5 that is disposed on the directing unit 10 so that emitting is carried out towards the area in which the unmanned aircraft is located.

The defense apparatus 1 can be used flexibly, because it can jointly form a communications network with further defense apparatuses and other external signal sources, such as the operating device or external sensors shown, by using which coordinated detection and combating of unmanned aircraft is enabled. For this purpose, the communications device 2 is constructed to provide a communications network for external signal sources, or, if a communications network already provided by a further external signal source is detected, to integrate itself into that network. In order to provide information, about a structure of the overall protective configuration that is formed, to defense apparatuses 1 participating in the communications network or other external signal sources 22, further information about the defense apparatus 1 is transmitted to the further members of the communications network by the control device 4 by using the communications device 2. In particular, with a position sensor 21, for example a GPS sensor, a position of the defense apparatus 1 is detected and transmitted to the further defense apparatuses 1 or the signal sources 22. In addition, the orientation of the defense apparatus can be determined and transmitted, for example by magnetic field sensors that are not shown. The positions and orientations of the defense apparatuses 1 facilitate in particular the fusion of sensor data or environment data of different sources in the communications network and also enable coordinated combating of unmanned aircraft, for example by the simultaneous emission of an electromagnetic pulse by a plurality of the defense apparatuses 1.

Figure 2:
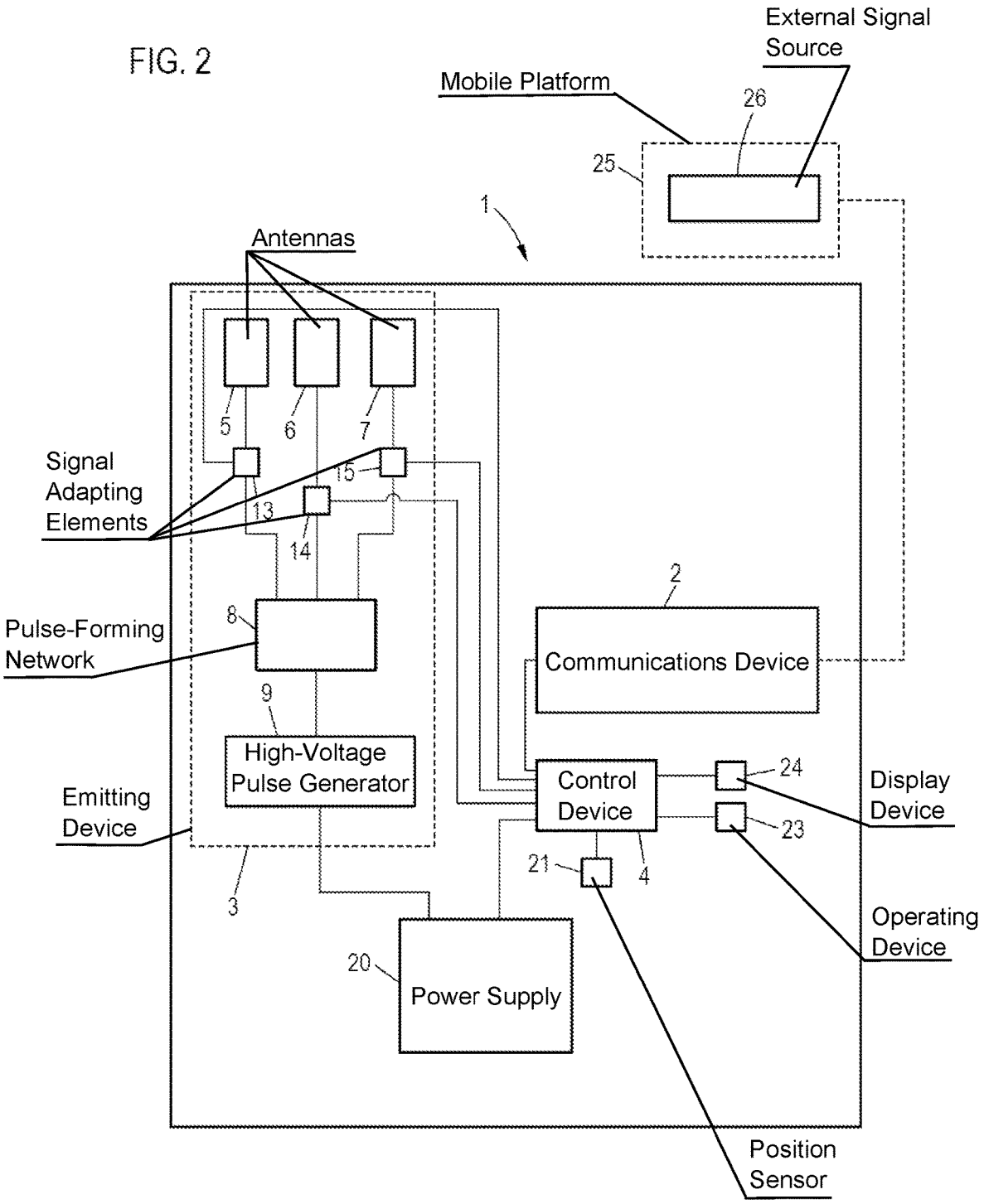

FIG. 2 shows a further exemplary embodiment of a defense apparatus for combating an unmanned aircraft. The defense apparatus 1 represented in FIG. 2 includes a very similar construction to the defense apparatus 1 shown in FIG. 1. Identical or functionally identical components are therefore referred to with the same reference characters, and only differences from the defense apparatus 1 shown in FIG. 1 are described in the following description.

The defense apparatus 1 according to FIG. 2 does not include a dedicated sensing system. Therefore, for the detection, recognition and tracking of unmanned aircraft, only sensor data or data derived from sensor data are used that are provided by an external sensor device, i.e. an external signal source 26, which is disposed on a mobile platform 25, namely a balloon, an airship or similar. For reasons of clarity, only one individual external signal source 26 is shown. Clearly, a plurality of external sensor devices can be used in order to detect unmanned aircraft. In the simplest case, data from one or more of the sensors that are not shown and that are provided on the sensor device are transmitted by the external sensor device directly to the control device 4 by using the communications device 2. Alternatively or additionally, data analysis, for example fusion of the data of a plurality of sensors or object recognition, could already be carried out by the external sensor device and already analyzed data could be provided to the defense apparatus 1.

The defense apparatus 1 shown in FIG. 2 includes an operating device 23 as well as a display device 24 on the defense apparatus 1 itself. This enables configuration of the defense apparatus 1 and control of the defense apparatus 1 to be carried out in the defense apparatus 1 itself. For example, it is possible to manually trigger emission of a high-energy electromagnetic pulse and/or in the event of the recognition of an unmanned aircraft to confirm triggering of the emitting device. The operating device 23 and the display device 24 further increase the flexibility of the defense apparatus 1, because it is thereby possible to use the defense apparatus 1 without an external operating device. Of course, it is also possible to still use the defense apparatus 1 in protective configurations including one or a plurality of external operating devices, for example in order to control complex combinations of defense apparatuses 1. The provision of the operating device 23 on the defense apparatus 1 enables it to also control further defense apparatuses 1 by transmitting control information by using the communications device 2.

The defense apparatus 1 shown in FIG. 2 also uses another device for determining the emitting direction of the electromagnetic pulse. The defense apparatus 1 includes for this purpose a plurality, in this example three, of antennas 5, 6, 7, to which the electromagnetic pulse produced by the pulse-forming network 8 can be delivered. A signal adapting element 13, 14, 15 in each case, that adjusts the amplitude and the phase of the signal transmitted to the antenna in order to influence an emitting direction, is disposed between the pulse-forming network 8 and the antennas 5, 6, 7. The adjustment of an emitting direction of an antenna array with a plurality of antennas by adjustment of the signals delivered to the respective antennas is basically known and will not be described in detail.

Individual features of the defense apparatuses 1 shown in FIG. 1 and FIG. 2 are clearly able to be combined. For example, it is possible to provide both a sensing system 16 and also an operating device 23 and/or a display device 24 in a defense apparatus 1. Alternatively, an external sensor device and an external operating device can be exclusively used in order to operate the defense apparatus 1 and to acquire environment data for the defense apparatus 1. Determination of the emitting direction of the electromagnetic pulse by a directing unit or by a plurality of antennas with associated signal adapting elements can be used interchangeably or can be combined.

Figure 3:
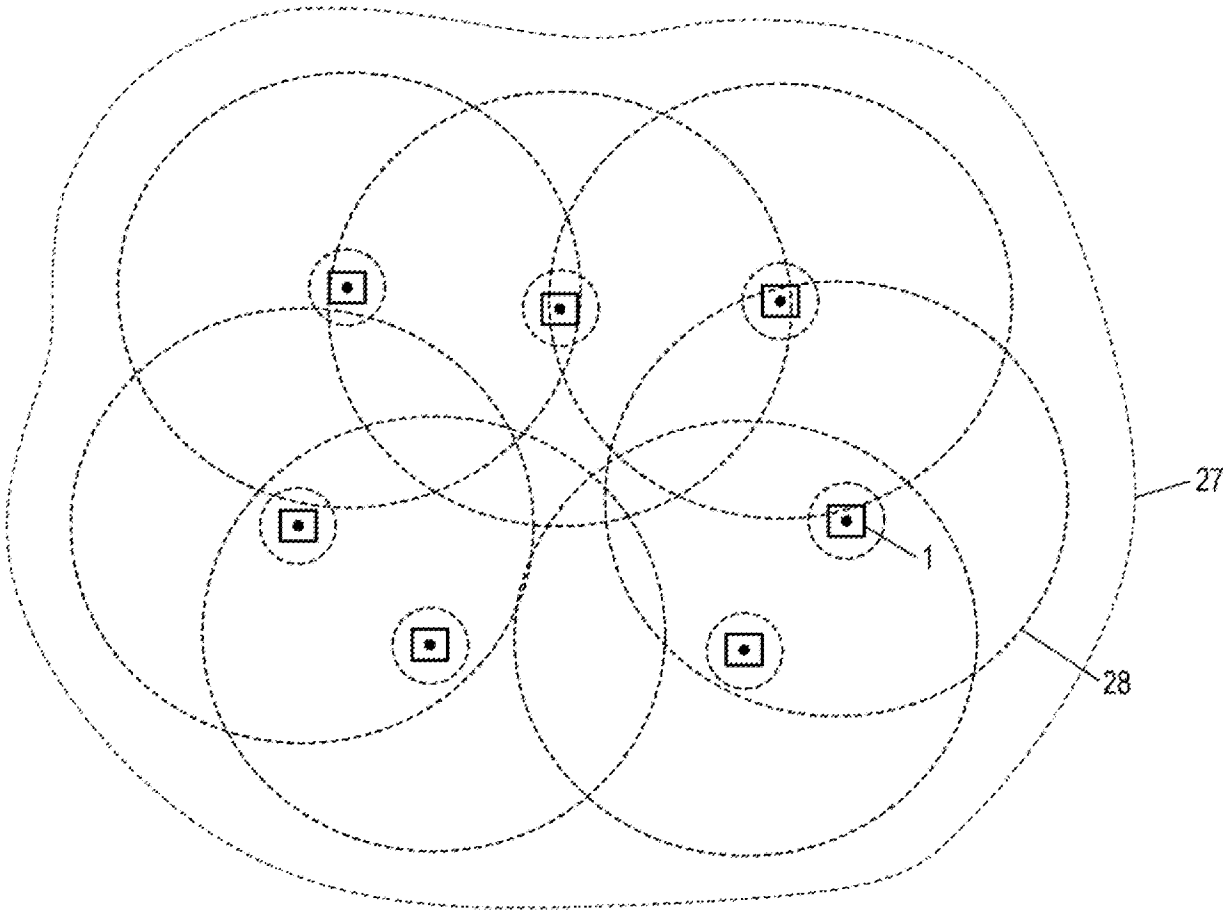
FIGS. 3 and 4 are diagrams showing exemplary embodiments of a protective configuration according to the invention that is operated according to an exemplary embodiment of the method according to the invention.

FIG. 3 shows an exemplary embodiment of a protective configuration for combating an unmanned aircraft. In the simple exemplary embodiment shown, a plurality of defense apparatuses is used in order to enable combating of unmanned aircraft within an effective range 27 of the protective configuration, which is far greater than the effective range 28 of an individual defense apparatus 1. The emission of the electromagnetic pulse by the defense apparatuses 1 is carried out in each case by using an antenna that emits the electromagnetic pulse substantially in an undirected manner. Emission can in particular be carried out in a funnel-shaped upwardly directed solid angle segment in order to prevent or inhibit the emission of the electromagnetic pulse in the operating plane of the defense apparatus 1.

Each of the defense apparatuses 1 includes a sensing system as well as an operating device in order to monitor and control the operation of the protective configuration from any of the defense apparatuses. In addition, each of the defense apparatuses 1 includes acoustic, optical and electromagnetic sensors for monitoring an airspace potentially containing the unmanned aircraft. The communications devices of the defense apparatuses are constructed to automatically provide a communications network, or to integrate within a provided communications network. Therefore, in the event of the activation of the defense apparatuses 1, a communications network in which the defense apparatuses 1 communicate with each other is automatically constructed.

When constructing the communications network, one of the defense apparatuses 1 is selected as the "master." The control device of the selected defense apparatus 1 coordinates the communications between the defense apparatuses 1 and carries out a central analysis of sensor data for object recognition as well as central control of the triggering of the emission directions of the defense apparatuses 1. In order to detect the environment sector, sensors are provided in each of the defense apparatuses 1 and the sensor data of the sensors are transmitted to the defense apparatus 1 selected as the "master." There the sensor data of all of the defense apparatuses 1 are fused and object recognition is carried out in the sensor data.

If penetration by an unmanned aircraft is detected within the effective range 27, the control device of the defense apparatus that was selected as the "master" determines the emitting device of the defense apparatuses that are to be activated. It is possible to activate one or a plurality of the emitting devices. If the associated emitting device is activated, then the control device directly controls the emitting device to emit a high-energy electromagnetic pulse. If the emitting devices of other defense apparatuses 1 are activated, then the control device controls the communications device to transmit corresponding communications information to the corresponding defense apparatuses 1. It is possible to coordinate the emission point in time by the provision of a time stamp describing a triggering time, as well as by a wait interval before activating its own emitting device. For this purpose, it is advantageous if in addition time synchronization is carried out in the communications network of the protective configuration.

The detection, recognition and triggering of a pulse by the protective configuration can be carried out automatically or autonomously.

In a development of the protective configuration, it is possible that emission of the electromagnetic pulse is only carried out if that emission is confirmed by a user. Confirmation of the triggering is possible in the operating device of any of the defense apparatuses, but it is also possible to select one of the defense apparatuses in which operating inputs are detected.

Figure 4:
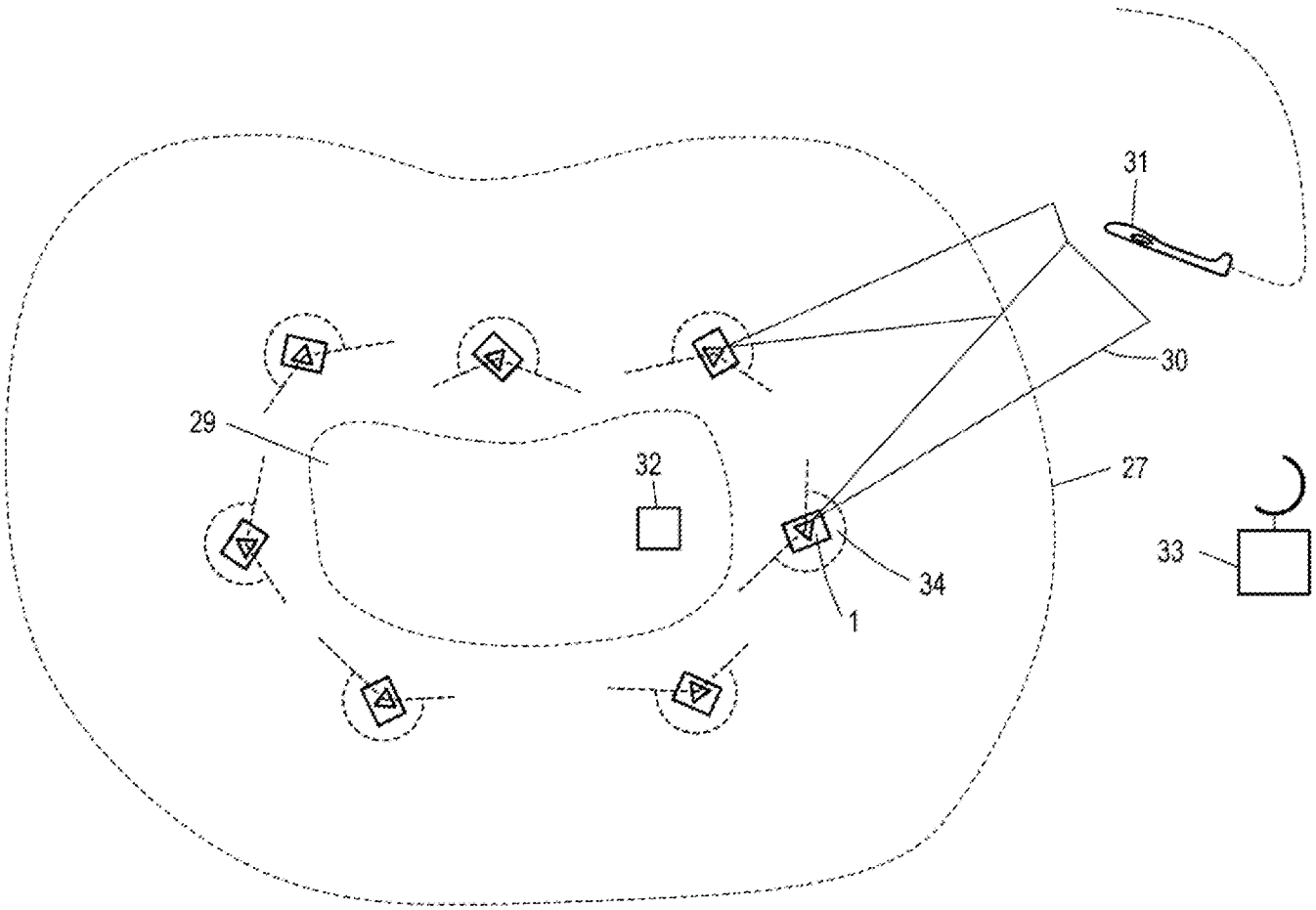

FIG. 4 shows a further exemplary embodiment of a protective configuration for combating an unmanned aircraft. In this exemplary embodiment, the protective configuration also includes a plurality of defense apparatuses 1, whereby a greater effective range 27 is achieved in which an unmanned aircraft can be combated than with the use of an individual defense apparatus 1. The significant difference from the protective configuration shown in FIG. 3 is that defense apparatuses 1 are used that emit the respective electromagnetic pulse in a predetermined solid angle range 30 relative to the antenna, i.e. in a directed manner. The antenna is disposed on a directing unit and is thereby pivotable about two pivot axes, so that emission in any solid angle in a solid angle range 34 is possible by pivoting the antenna. The solid angle range 34 is limited because of the mechanical construction of the defense apparatus 1. The plurality of defense apparatuses are disposed so that an area 29 to be protected is fully included in the effective range 27.

In an embodiment that is not shown, it would also be possible to not mechanically limit the angular range 34 in which emission of the electromagnetic pulse is possible. If, nevertheless, the effective range is to be blocked in the protective area 29, i.e. a protective area 29 is to be predetermined in which it is ensured that no emission of an electromagnetic pulse is carried out in that area by the protective configuration, for example the pivoting of the antennas can be limited by suitably programming the defense apparatuses 1 of the protective area 29.

The protective configuration includes an external sensor device 33 as well as an operating device or apparatus 32 in addition to the defense apparatuses 1. The functions of the external sensor device and the external operating device have already been described with reference to FIG. 1 or 2. In the protective configuration, the operating device 32 is always used as the "master" and carries out the analysis of the sensor data of the sensor device 33 as well as the sensor data provided by the defense apparatuses 1.

An unmanned aircraft 31 within the vicinity of the effective range 27 is detected by object recognition carried out by the operating device 32. In order to prepare for combating the unmanned aircraft 31, communications information is transmitted by the operating device 32 to the defense apparatuses 1 nearest to the unmanned aircraft 31, which instructs the defense apparatuses 1 to orient the antennas thereof towards the unmanned aircraft 31 by activating the corresponding actuators. A video image containing the unmanned aircraft 31 is also displayed on a display device that is not shown of the operating device. If the unmanned aircraft 31 penetrates within the effective range 27, then a user is signaled to the effect that combating of the unmanned aircraft 31 is possible. If that user confirms combating of the unmanned aircraft 31 to the operating device 32, then communications information is transmitted to the defense apparatuses 1 nearest to the unmanned aircraft 31 in order to trigger the emission of the electromagnetic pulse. Through the use of such coordinated emission of the electromagnetic pulse, the intensity of the electromagnetic pulse can be increased and thereby the effectiveness thereof can be improved.

FIGS. 5 through 9 show possible constructions of a communications network used in different exemplary embodiments of a protective configuration for combating an unmanned aircraft. The communications connections of the communications networks shown can be implemented in a wireless, wired or partly wireless or partly wired form.

Figure 5:
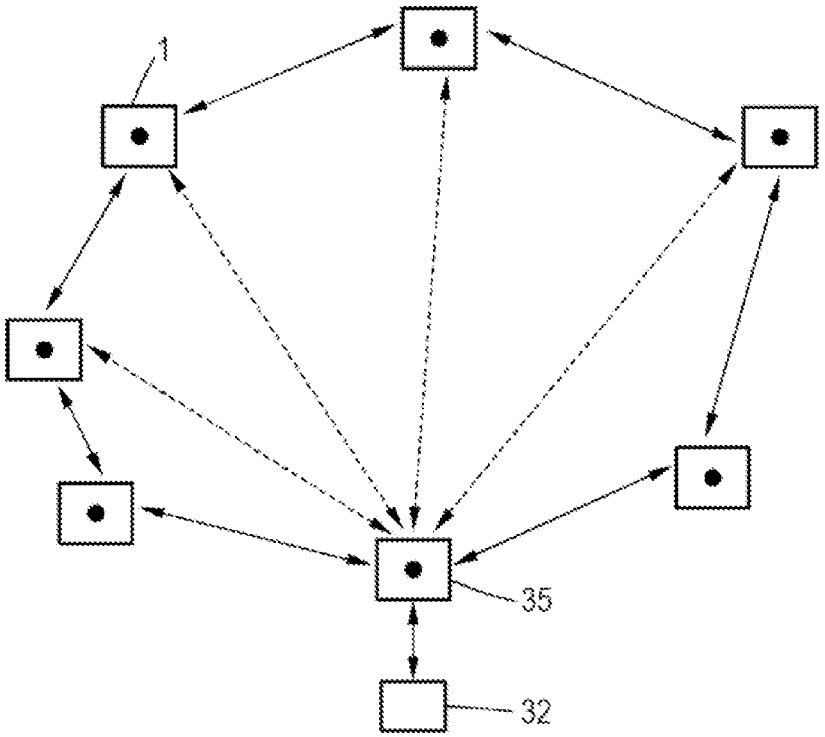
FIGS. 5 through 9 are diagrams showing the communications in communications networks of different exemplary embodiments of a protective configuration according to the invention.

FIG. 5 shows a communications network organized as a ring, in which each of the defense apparatuses 1 of the protective configuration communicates with exactly two further defense apparatuses 1. One of the defense apparatuses 1 is selected as the "master" 35. The transmission of communications information from the "master" 35 to any optional defense apparatus 1 is possible, because an address is associated with each of the defense apparatuses 1 and communications information can be forwarded by the further defense apparatuses 1 lying between the "master" 35 and the addressed defense apparatus 1. This is indicated by the dashed arrows. An operating device 32 communicates exclusively with the "master" 35.

Figure 6:
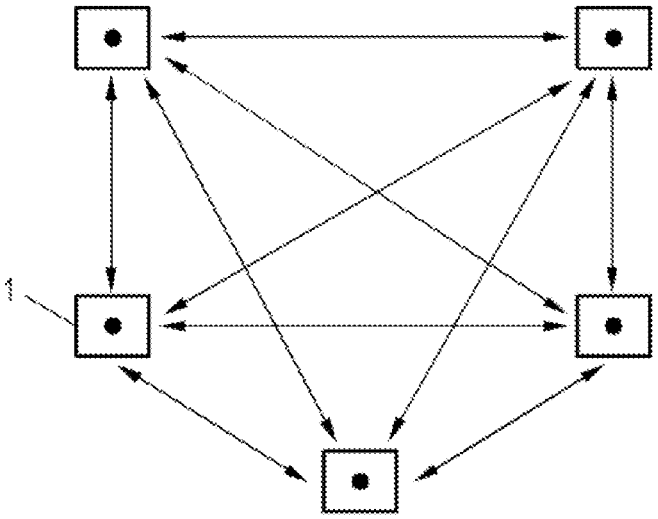

FIG. 6 shows a network structure in which no "master" is selected, but each of the defense apparatuses 1 communicates with equal rights with each of the other defense apparatuses 1.

Figure 7:
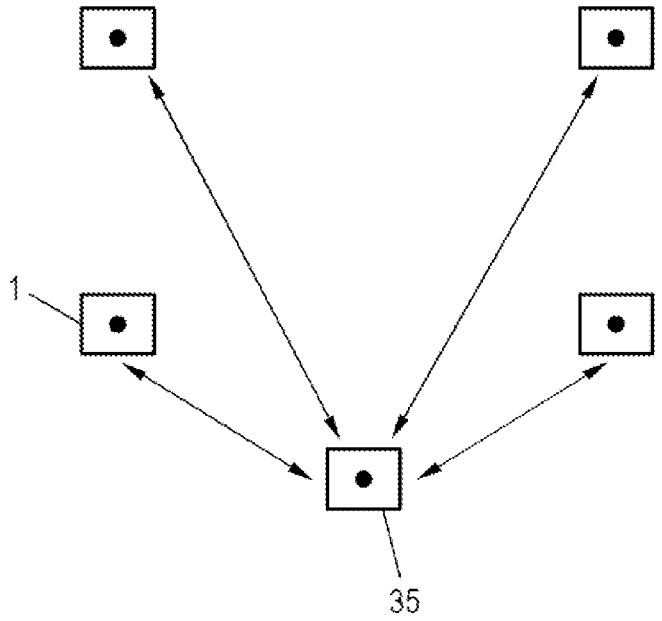

FIG. 7 shows a network structure in which one of the defense apparatuses 1 is selected as the "master" 35, wherein in contrast to the network structure shown in FIG. 5 the "master" 35 is directly connected to each individual defense apparatus 1 by using a communications channel.

Figure 8:
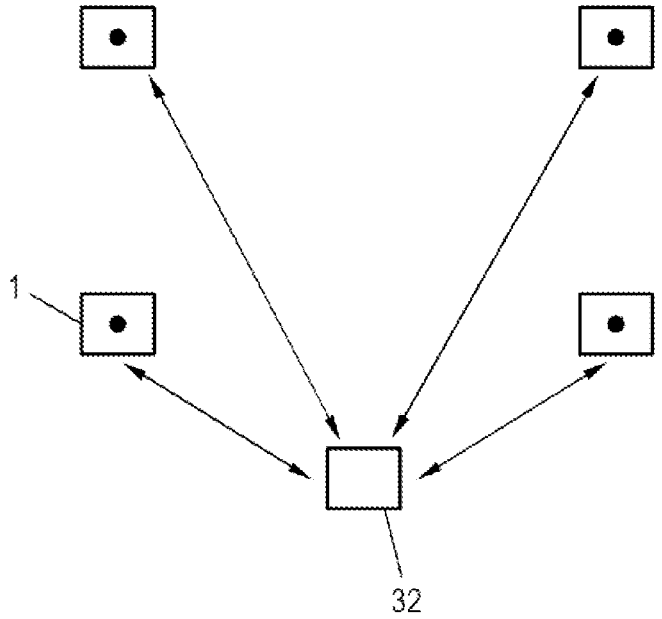

FIG. 8 shows a network that is structurally identical to FIG. 7, wherein an operating device 32 is acting as the "master" and communicates directly with each of the defense apparatuses 1.

Figure 9:
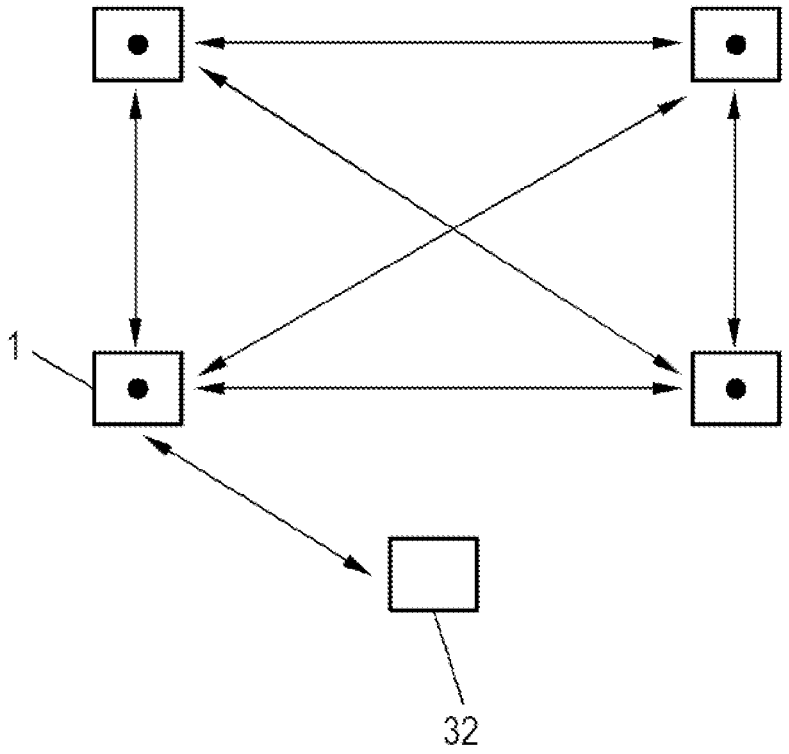

FIG. 9 shows a further network structure in which the defense apparatuses 1 communicate with each other with equal rights, wherein one of the defense apparatuses 1 communicates with an operating device 32 that is acting as the "master."

The structures of the communications network shown are purely by way of example. Clearly, a number of other network structures are possible.

The invention claimed is:

1. A defense apparatus for combating an unmanned aircraft, the defense apparatus comprising:

a communications device for receiving communications information transmitted by at least one external signal source;

an emitting device for producing and emitting a high-energy electromagnetic pulse upon triggering said emitting device;

a control device for triggering emission of the high-energy electromagnetic pulse depending on the communications information received by said communications device; and at least one sensor for detecting sensor data of an environment sector potentially containing the unmanned aircraft;

wherein said emitting device includes at least one antenna, a pulse-forming network and a high voltage pulse generator;

wherein said antenna is constructed for a directed emission of the electromagnetic pulse in a predetermined solid angle range relative to said at least one antenna; and wherein said control device is configured to control said communications device to transmit the sensor data or data derived from the sensor data to the external signal source.

2. The defense apparatus according to claim 1, which further comprises a defense apparatus housing, and a directing unit being pivotable relative to said defense apparatus housing about at least one pivot axis, said at least one antenna being disposed in said directing unit.

3. The defense apparatus according to claim 2, which further comprises at least one actuator each being associated with said at least one pivot axis for respectively pivoting said directing unit about said at least one pivot axis, said control device being configured for controlling said at least one actuator.

4. The defense apparatus according to claim 1, wherein said antenna is one of a plurality of antennas, said emitting device includes said plurality of antennas and an associated signal adapting element for at least one of said antennas, said signal adapting element being configured to change at least one of a phase position or an amplitude of a signal delivered to a respective one of said antennas for specifying a solid angle in which the emitting is carried out.

5. The defense apparatus according to claim 1, wherein said at least one sensor is at least one of an optical sensor, an acoustic sensor or an electromagnetic sensor.

6. The defense apparatus according to claim 1, wherein said control device is configured to acquire the sensor data and to carry out object recognition for a recognition of the unmanned aircraft depending on the sensor data.

7. The defense apparatus according to claim 6, wherein said control device is configured to trigger said emitting device depending on the recognition of the unmanned aircraft during the object recognition.

8. The defense apparatus according to claim 7, which further comprises an operating device, said control device being configured to trigger said emitting device following recognition of the unmanned aircraft only if at least one of an operating input confirming the triggering has been detected at said operating device or a triggering confirmation has been received by using said communications device as communications information from the external signal source.

9. The defense apparatus according to claim 6, wherein said control device is configured to acquire further environment data concerning an environment sector potentially containing the unmanned aircraft that was transmitted by the external signal source as communications information, and to analyze the further environment data during the object recognition.

10. The defense apparatus according to claim 1, wherein said communications device is configured for automatically providing a communications network for the external signal source or for automatically integrating within a communications network provided by the external signal source.

11. The defense apparatus according to claim 1, wherein said emitting device is configured for non-directionally emitting the high-energy electromagnetic pulse upon triggering said emitting device.

12. A protective configuration for combating an unmanned aircraft, the protective configuration comprising:

at least one defense apparatus according to claim 1; and at least one external signal source.

13. The protective configuration according to claim 12, wherein said at least one external signal source is an external sensor device including at least one sensor, a communications device and a control device configured for acquiring sensor data of said at least one sensor and for controlling said communications device for transmitting the sensor data or data derived from the sensor data as communications information to at least one of said defense apparatus or a further external signal source.

14. The protective configuration according to claim 12, wherein said at least one external signal source is an operating apparatus including an operating device for detecting operating inputs and a communications device on an operating device side for sending operating information dependent on detected operating inputs as communications information to at least one of said defense apparatus or a further external signal source.

15. The protective configuration according to claim 14, wherein said operating apparatus includes a display device and a control device, said control device is configured for acquiring environment information received by using said communications device concerning an environment sector potentially containing the unmanned aircraft and for displaying the environment information or information derived from the environment information on said display device.

16. The protective configuration according to claim 12, wherein said external signal source is a further defense apparatus according to claim 1.

17. A method for operating a protective configuration for combating an unmanned aircraft, the method comprising the following steps:

providing at least one external signal source;

providing at least one defense apparatus including:

a communications device for receiving communications information transmitted by the at least one external signal source, an emitting device for producing and emitting a high-energy electromagnetic pulse upon triggering the emitting device, a control device for triggering emission of the high-energy electromagnetic pulse depending on the communications information received by the communications device; and at least one sensor for detecting sensor data of an environment sector potentially containing the unmanned aircraft, wherein the emitting device includes at least one antenna, a pulse-forming network and a high voltage pulse generator, wherein the antenna is constructed for a directed emission of the electromagnetic pulse in a predetermined solid angle range relative to the at least one antenna, and wherein the control device is configured to control the communications device to transmit the sensor data or data derived from the sensor data to the external signal source; and triggering the emitting device of the defense apparatus only upon communications information concerning the triggering being received by the communications device.

18. The method according to claim 17, which further comprises providing a plurality of defense apparatuses disposed in such a way that areas of the environment in which the emission of the electromagnetic pulse by the respective emitting device is possible at least one of fully or partly enclose or cover an area to be protected.

19. The method according to claim 17, which further comprises:

providing the at least one defense apparatus or the at least one external signal source with at least one sensor acquiring sensor data;

carrying out object recognition in the sensor data by using at least one of the defense apparatus or the external signal source; and subsequently activating the emitting device of the at least one defense apparatus upon recognition of an unmanned aircraft or following detection of a confirmation by a user.

20. The method according to claim 19, which further comprises:

providing the at least one defense apparatus or the at least one external signal source with an output device and an operating device;

upon recognition of an unmanned aircraft, outputting information concerning the recognition to the output device; and triggering the emitting device following the detection of an operating input indicating confirmation of the triggering at the operating device.

21. The method according to claim 17, wherein the emitting device non-directionally emits the high-energy electromagnetic pulse upon triggering the emitting device.

* * * * *